US007144351B2

(12) United States Patent
Kastelic

(10) Patent No.: US 7,144,351 B2
(45) Date of Patent: Dec. 5, 2006

(54) MULTI-CONFIGURABLE EXERCISE DEVICE

(76) Inventor: Edward P. Kastelic, 1839 W. Mulrwood, Phoenix, AZ (US) 85045

( * ) Notice: Subject to any disclaimer, the term of this patent is extended or adjusted under 35 U.S.C. 154(b) by 589 days.

(21) Appl. No.: 10/690,682

(22) Filed: Oct. 22, 2003

(65) Prior Publication Data

US 2004/0082441 A1 Apr. 29, 2004

Related U.S. Application Data

(60) Provisional application No. 60/420,184, filed on Oct. 23, 2002.

(51) Int. Cl.
*A63B 22/04* (2006.01)
*A47B 57/00* (2006.01)

(52) U.S. Cl. ..... 482/52; 108/92

(58) Field of Classification Search ..... 482/23, 482/35, 36, 51, 52, 95, 96, 140–143, 148, 482/908; 128/845; 297/440.14; 108/91–96
See application file for complete search history.

(56) References Cited

U.S. PATENT DOCUMENTS

| | | | | | |
|---|---|---|---|---|---|
| 310,226 | A | | 1/1885 | Rice et al. | |
| 1,818,428 | A | | 8/1931 | Paysen | |
| 2,097,273 | A | * | 10/1937 | Feist | 482/52 |
| 2,575,593 | A | | 11/1951 | Perry | |
| 3,035,671 | A | * | 5/1962 | Sicherman | 52/183 |
| 3,102,265 | A | * | 8/1963 | Rice et al. | 342/361 |
| 3,229,430 | A | * | 1/1966 | Willie | 52/183 |
| 3,550,310 | A | * | 12/1970 | Wolfgang | 446/85 |
| 3,596,396 | A | * | 8/1971 | Thomson | 446/487 |
| 3,773,329 | A | * | 11/1973 | Secter | 273/153 R |
| 4,223,945 | A | | 9/1980 | Nikitits | |
| 4,478,413 | A | | 10/1984 | Siwula | |
| 4,875,681 | A | * | 10/1989 | Ofir | 273/155 |
| 5,066,001 | A | | 11/1991 | Wilkinson | |
| 5,354,247 | A | * | 10/1994 | Wilkinson | 482/52 |
| 5,357,876 | A | * | 10/1994 | Kniefel et al. | 108/92 |
| 5,474,509 | A | * | 12/1995 | Hodgdon | 482/52 |
| 5,512,026 | A | | 4/1996 | Wilkinson | |
| 5,538,452 | A | * | 7/1996 | Kurani | 446/102 |
| 5,540,638 | A | * | 7/1996 | Wilkinson | 482/52 |
| 5,855,536 | A | | 1/1999 | Wilkinson | |
| 5,899,838 | A | * | 5/1999 | Jacobs | 482/142 |

(Continued)

*Primary Examiner*—Jerome Donnelly
*Assistant Examiner*—Tam Nguyen
(74) *Attorney, Agent, or Firm*—Venable, Campillo, Logan & Meaney, P.C.

(57) ABSTRACT

The invention is incorporated in an exercise device comprising three blocks: a "first block", a "second block" and a "third block". Each block has a horizontal platform (herein, "first horizontal plafform", a "second horizontal platform" and a "third horizontal platform") upon which the user can stand on and perform all types of exercise activity. It is preferred that three blocks are connected together by two hinges (herein, a "first hinge" and a "second hinge"). It is also preferred that the three block be of graduating heights. It is preferred that the first hinge be connected between the first block and a first vertical corner of the second block so that the first hinge rotates about an first axis that that is perpendicular to the plane formed by the first horizontal platform. It is also preferred that the second hinge be connected between the third block and the second vertical corner of the second block so that the second hinge rotates about a second axis that that is perpendicular to the plane formed by the second horizontal platform. In the preferred embodiment, the first vertical corner of the second block is diagonally opposite from the second vertical corner of the second block.

17 Claims, 5 Drawing Sheets

U.S. PATENT DOCUMENTS 6,063,007 A * 5/2000 Sithole ..... 482/52
6,206,805 B1 3/2001 Helton et al.
6,402,664 B1 * 6/2002 Marston ..... 482/52
6,964,246 B1 * 11/2005 Wolfington et al. ..... 119/849

* cited by examiner

MULTI-CONFIGURABLE EXERCISE DEVICE

CROSS-REFERENCE TO RELATED APPLICATION

The present application claims priority to copending US provisional application entitled "Multi-configuration tri-block fitness training apparatus and exercise system," having Ser. No. 60/420,184, filed Oct. 23, 2002 by inventor Edward P. Kastelic, which is entirely incorporated herein by reference.

BACKGROUND OF THE INVENTION

1. Field of the Invention

The present invention relates generally to an exercise device and, more specifically, to an exercise device that can be arranged into varying configurations allowing the user to perform a variety of exercises and activities.

2. Background of the Invention

There are many exercise devices on the market today. The exercise community is continuously searching for an exercise device that provides maximum health and weight loss results while still being functional and easy to store away. Prior exercise apparatus have been disclosed in the following United States patents: U.S. Pat. No. 6,402,664 (T J Marston), U.S. Pat. No. 6,206,805 (K J Helton, et al), U.S. Pat. No. 6,063,007 (D Sithole), U.S. Pat. No. 5,899,838 (L J Jacobs), U.S. Pat. No. 5,855,536 (W T Wilkinson), U.S. Pat. No. 5,512,026 (W T Wilkinson), U.S. Pat. No. 5,474,509 (D W Hodgdon), U.S. Pat. No. 5,354,247 (W T Wilkinson), U.S. Pat. No. 5,066,001 (W T Wilkinson), U.S. Pat. No. 4,478,413 (J T Siwula), U.S. Pat. No. 4,223,945 (E Nikitits), U.S. Pat. No. 3,229,430 (W Berg), U.S. Pat. No. 4,026,016 (L Heftel), U.S. Pat. No. 2,575,593 (J C Perry), U.S. Pat. No. 2,097,273 (S E Feist), U.S. Pat. No. 1,818,428 (M Paysen), U.S. Pat. No. 310226 (D B Rice et al.). None of the above patents, however, discloses the aspects of the current invention.

SUMMARY OF THE INVENTION

The invention is summarized below only for purposes of introducing embodiments of the invention. The ultimate scope of the invention is to be limited only to the claims that follow the specification.

Generally, the invention is incorporated in an exercise device comprising three blocks: a "first block", a "second block" and a "third block". Each block has a horizontal platform (herein, "first horizontal platform", a "second horizontal platform" and a "third horizontal platform") upon which the user can stand on and perform all types of exercise activity. It is preferred that three blocks are connected together by two hinges (herein, a "first hinge" and a "second hinge"). It is also preferred that the three blocks be of graduating heights.

It is preferred that the first hinge be connected between the first block and a first vertical corner of the second block so that the first hinge rotates about an first axis that that is perpendicular to the plane formed by the first horizontal platform. It is also preferred that the second hinge be connected between the third block and the second vertical corner of the second block so that the second hinge rotates about a second axis that that is perpendicular to the plane formed by the second horizontal platform. In the preferred embodiment, the first vertical corner of the second block is diagonally opposite from the second vertical corner of the second block. By configuring the blocks and hinges this way, an "accordion-like" device is achieved to allow the user to adjust the exercise device into a variety of configurations and orientations.

The exercise device of the present invention allows the user to perform a variety of exercises and activities. Connecting the three blocks of varying heights by swivel means at the corners allows for unlimited possibilities of configurations, exercises, stabilization of apparatus, direction, and range of motion. Each block can be easily disassembled, unlocked, disconnected or unhinged and neatly stacked for purpose of portability. The multi-tiered system has "ready to go" inherent progressive resistance. The range of motion possibilities allows arcs of upper or lower torso limb movement in all planes of motion with increased vertical depth and spheres. The exercise device can be used in unison with other types of exercise tools such as dumbbells, weighted pipes, sticks, and medicine balls.

The exercise device can also have insertion points on the platforms to further increase the range of activities. Insertion points allow for the attachment of one or more stabilizer bars, pipes with handle for additional individual balance support, and other exercise enhancing attachments. An additional height level cap can be placed on each level to build a wider and level base. The wider base can be used for plyometric type exercises, single/dual foot step-ups when unit is in "tri-fold" configuration and when configured inline (I formation) it makes a sturdy weight bench.

The apparatus is a strength and bodybuilding tool for the upper body as well, useful for bi-level push-ups, dips, and abdominal balance and bridge movements and holds at multiple-levels. Along with resistance from range of motion and varying heights and planes of movement, the exercise device works synergistically and is intended to work in unison with resistances such as dumbbells, weighted pipes, sticks, medicine balls or other implements. It can be used for individual home or fitness gym use. The exercise device also serves as a flexibility stretching apparatus.

Light strong materials, such as aluminum or plastic or any other durable, light material are the desired construction material. A comfort pad or resistance grip can be added to block platform for increased functionality. Each exercise device can be assembled and built to varying heights, the top level ideally set to fit to a users' knee level for 90 degree maximum knee bend with single foot placement. Each subsequent lower level is positioned to a proportional height. The exercise device can be built for different sizes of people and leg heights for maximum benefit. Although primarily invented for health and fitness training, the device can also be used as stepladder, bench, or other structural support.

The description of the invention that follows, together with the accompanying drawings, should not be construed as limiting the invention to the example shown and described, because those skilled in the art to which this invention appertains will be able to devise other forms thereof within the ambit of the appended claims.

DESCRIPTION OF PREFERRED EMBODIMENTS

Figure 1:
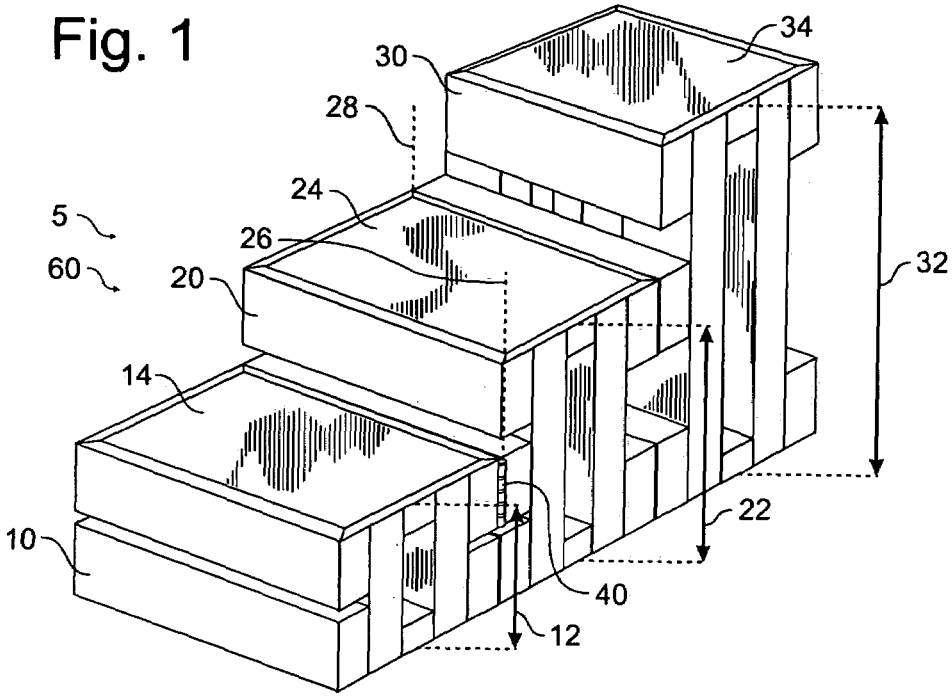
FIG. 1 illustrates a first preferred configuration of the exercise device 5.

It is to be understood that the descriptions below are merely illustrative of the presently preferred embodiments of the invention and that no limitations are intended to the detail of construction or design herein shown other than as defined in the appended claims. In this specification, the term "slip hinge" refers to any hinge manufactured for a "take-apart" application. In this specification, the term "latch hinge" refers to a slip hinge that can be locked into place if desired. In this specification the term "flag hinge" refers to a hinge having total swivel capability (i.e., that allows the hinge to travel a full 360 around the pin). Examples of slip hinges, latch hinges and flag hinges can be found on the website published by H. A. Guden Co., Inc. at www.guden-.com.

In the preferred embodiment, the exercise device 5 generally comprises three blocks or step units, hereinafter referred to as "block(s)", a second block 20, a third block 30, a first hinge 40 and a second hinge 50. The first block 10 further comprises a first height 12 and a first horizontal platform 14. The second block 20 further comprises a second height 22, a second horizontal platform 24, a first vertical corner 26 and a second vertical corner 28, wherein the first vertical corner 26 is diagonally opposite from the second vertical corner 28. The third block 30 further comprises a third height 32 and a third horizontal platform 34.

As illustrated in FIG. 1, the first hinge 40 is connected to the first block 10 and the first vertical corner 26 of the second block 20. As such, the first hinge 40 rotates about a first axis 42 that that is perpendicular to the plane formed by the first horizontal platform 14. The second hinge 50 is connected to the third block 30 and the second vertical corner 28 of the second block 20. As such the second hinge 50 rotates about a second axis 52 that that is perpendicular to the plane formed by the second horizontal platform 24.

It is preferred that the first horizontal platform 14, the second horizontal platform 24 and the third horizontal platform 34 be rectangular in shape, but most any shape can be used. In a rectangular configuration, it is preferred that a horizontal platform be 8 to 12 inches wide and 14 to 16 inches long.

Figure 2:
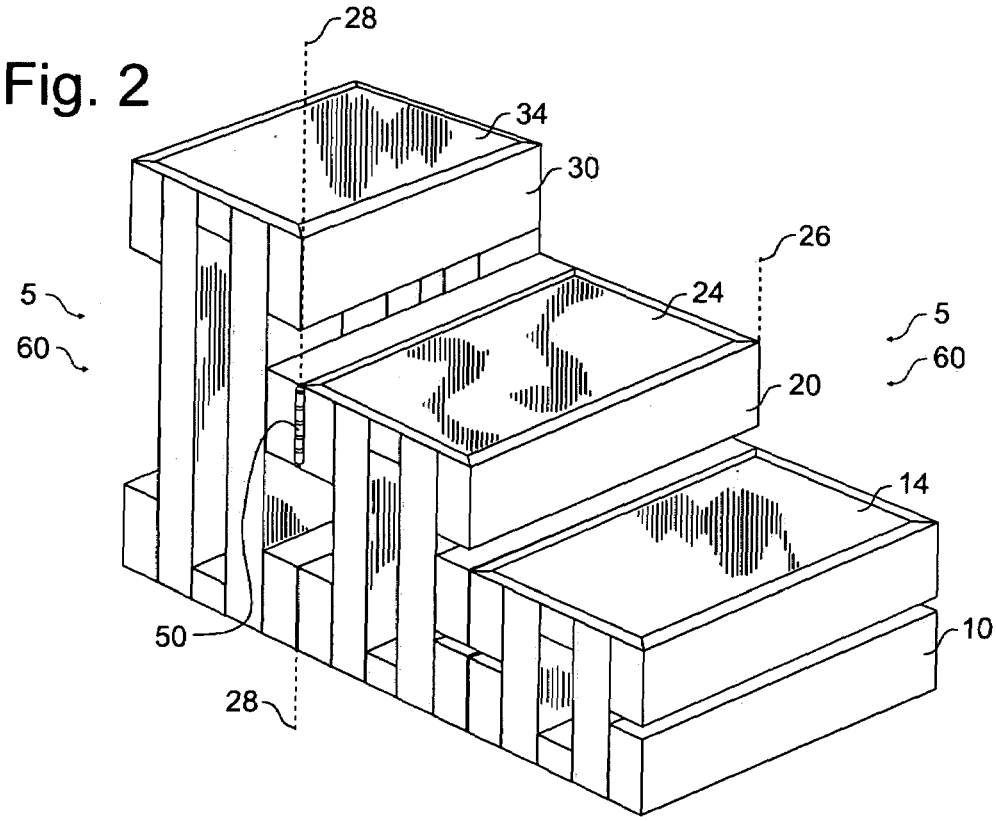
FIG. 2 illustrates the opposite side of the first preferred configuration of the exercise device 5 shown in FIG. 1.
Figure 3:
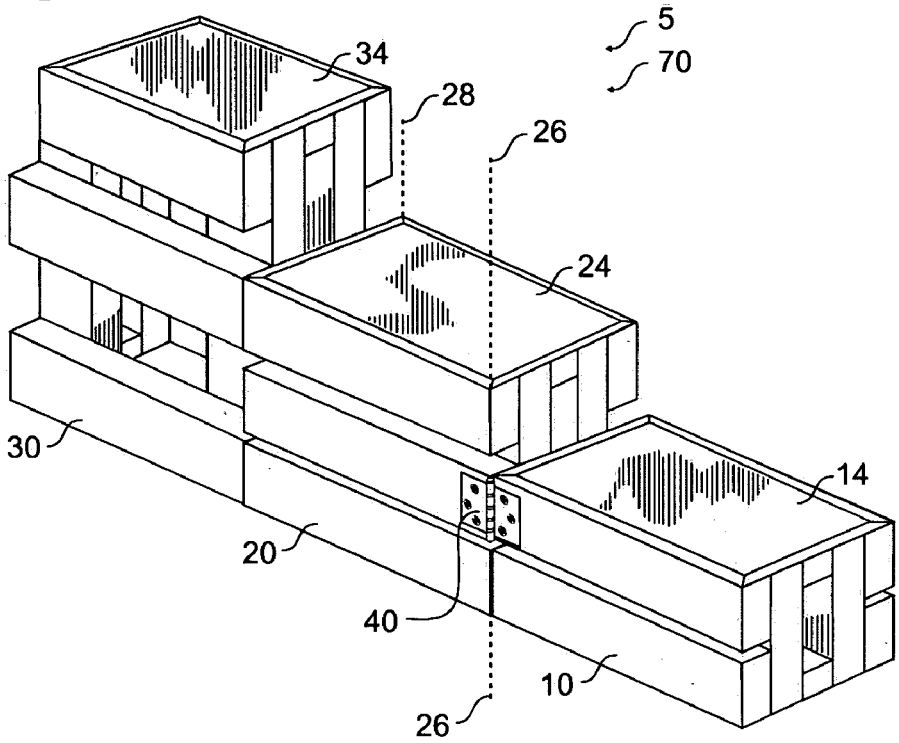
FIG. 3 illustrates a second preferred configuration of the exercise device 5.
Figure 4:
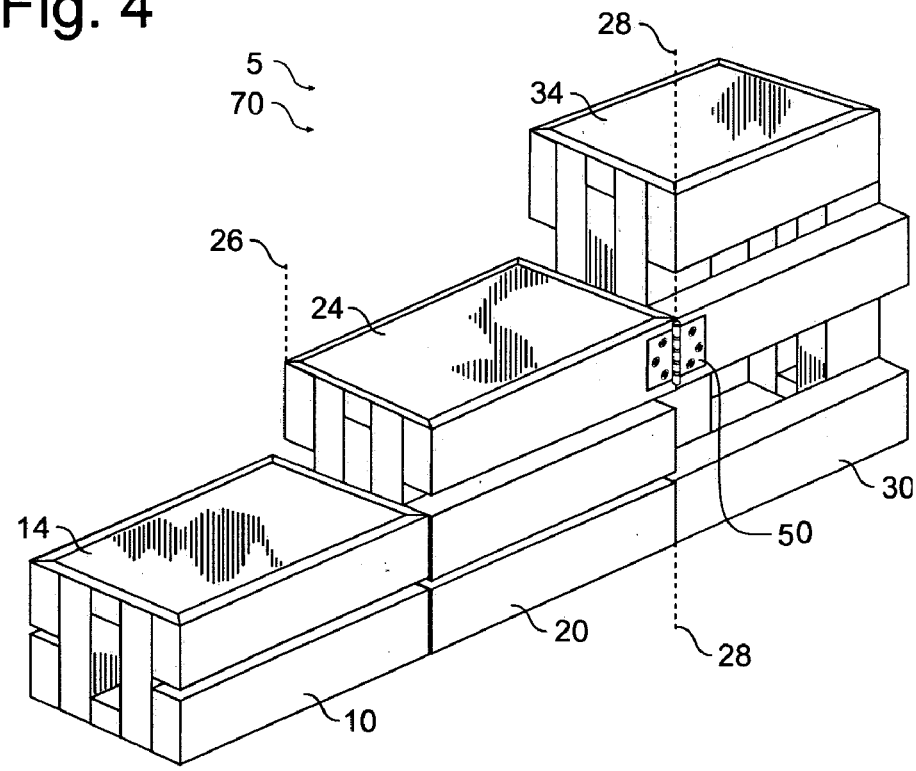
FIG. 4 illustrates the opposite side of the second preferred configuration of the exercise device 5 shown in FIG. 4.

In the preferred embodiment, the exercise device 5 further comprises a first position 60 and a second position 70, wherein the spatial orientation of the first block 10, the second block 20 and the third block 30 of the first position 60 is different from the spatial orientation of the first block 10, the second block 20 and the third block 30 of the second position 70. For example, FIGS. 1 and 2 illustrate an exercise device 5 in the preferred first position 60. By rotating the first block 10 counterclockwise in relation to the second block 20 and by rotating the third block 30 counterclockwise in relation to the second block 20 the exercise device can be converted from the first position 60 to the second position 70. The preferred second position 70 is illustrated in FIGS. 3 and 4.

Turning again to FIGS. 1 and 2, the first hinge 40 and second hinge 50 are each in a closed position when the exercise device 5 is configured in the preferred first position 60. In the preferred embodiment, when the first hinge 40 and the second hinge 50 are closed, the first block 10, the second block 20, and the third block 30 are arranged according to their width. As shown in FIGS. 3 and 4, the first hinge 40 and the second hinge 50 are in an open position when the exercise device 5 is configured in the preferred second position 70. As such, the first block 10, the second block 20, and the third block 30 are arranged according to their length. The two different configurations allow the user of the exercise device 5 to perform different types of exercises and activities depending on whether the first hinge 40 and the second hinge 50 are open or closed, and the configuration of the first block 10, the second block 20, and the third block 30.

Figure 8:
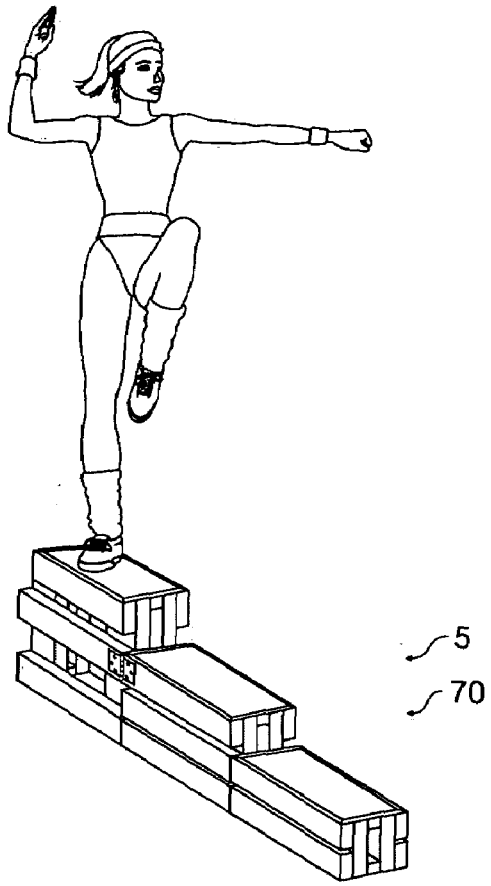
FIG. 8 illustrates a user on a second preferred configuration of the exercise device 5.

FIG. 8 shows a preferred embodiment of the exercise device 5 with a user performing an exercise or activity when the first hinge 40 and the second hinge 50 are in the open position, and the first block 10, the second block 20, and the third block 30 are arranged according to their length. The exercise device can also be configured and utilized in any position between the first position 60 and the second position 70. The exercise device 5 is not limited to a three block and two hinge configuration. For example, slip hinges can be placed some or all of the corners of the first block 10, second block, 20, and third block 30 to enable the creation of a variety of different shapes and configurations. Likewise, two blocks can be used or more than three blocks can be used.

The placement of the first hinge 40 and the second hinge 50 on opposite sides of the exercise device 5 allows the first block 10, the second block 20, and third block 30 to move in an "accordion-like" manner. It is preferred that the first hinge 40 and the second hinge 50 are latch hinges, but slip hinges and flat hinges can also be advantageous. By using a latch hinge, the exercise device can be locked together during use, disassembled for easy storage and reassembled use as desired.

As pictured in FIGS. 1–8, the exercise device 5 is constructed from wood. In particular, FIGS. 1–8 illustrate an exercise device 5 constructed using 2" by 4" and 2"×2" construction grade pine for each box and ½" plywood to form the platforms. Wood construction is suitable and preferred for cost-effective custom-built exercise devices 5. Many other materials can be used. It is preferred to use aluminum construction for its strength and relatively lighter weight. Plastics, composites and other known structural materials could, of course, be used.

In one alternative embodiment, the first block 10 can be constructed so that it fits inside of the second block 20, and the second block 20 can be constructed so that it fits into the third block 30. By constructing the blocks in this fashion and using a slip or latch hinge, the first block 10, the second block 20, and third block 30 can be detached from each other and stored inside one another for compact storage.

Figure 9:
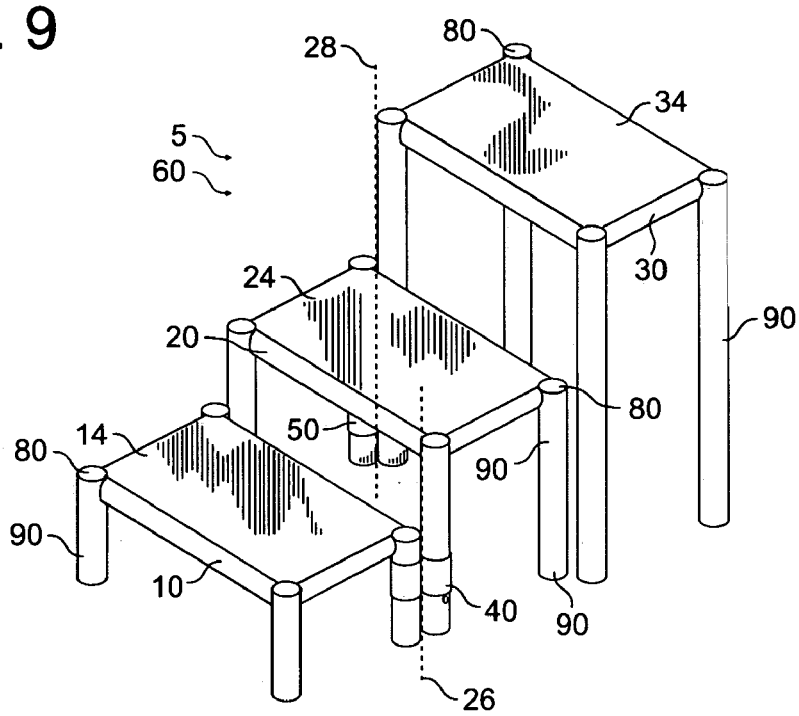
FIG. 9 illustrates an alternative embodiment of the exercise device 5.
Figure 10:
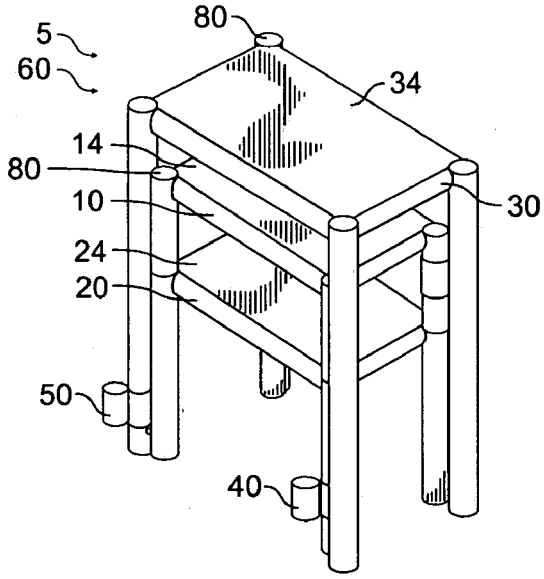
FIG. 10 illustrates the alternative embodiment of FIG. 9, having the first block 10 stacked on top of the second block 20, and having both the first block 10 and second block 20 stored underneath the third block 30.
Figure 11:
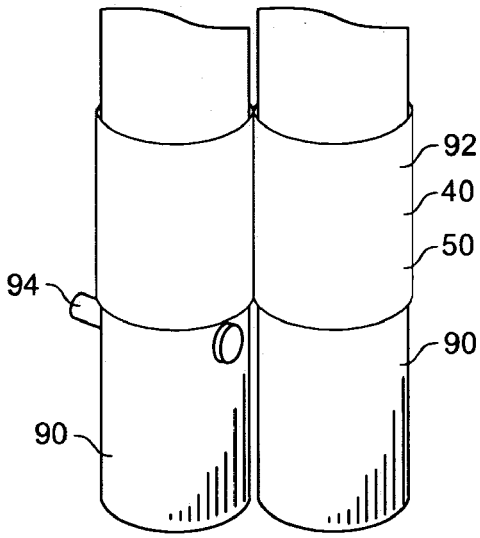
FIG. 11 illustrates an alternative hinge for use with the alternative embodiment of FIG. 9.

FIGS. 9–11 illustrate an alternative embodiment of an exercise device 5 where the first block 10 fits on top of the second block 20, and the first block 10 and second block 20 fit underneath the third block 30. The alternative embodiment illustrated in FIGS. 9–11 is preferably constructed from metal such as aluminum. Each of the three blocks (the first block 10, the second block 20, and the third block 30) comprises a horizontal platform (the first horizontal platform 14 the second horizontal platform 24, and the third horizontal platform 34) supported by four tubular columns 90. The top of each tubular column 90 can be capped or the top of each tubular column can be used as an insertion point 80 (as discussed more fully in a later section of the specification).

Using an embodiment where the blocks could fit inside each other is helpful to store the exercise device 5 inside a bag with drawstring or for the addition of a handle device directly onto the exercise device 5 for portability. In addition, the tubular columns 90 could be detachable from the horizontal platforms using a releasable connection such as a hook and slip lock connection for even more compact storage. Also, the tubular columns 90 could be manufactured in various lengths using a releasable connection such as a hook and slip lock connection to promote compact storage and greater adaptability of configuration.

For the alternate embodiment of FIGS. 9–11, the first hinge 40 and the second hinge 50 are preferably two hollow sleeves 92 connected to each other. The inside diameter of the two hollow sleeves 92 should be marginally bigger than the outside diameter of the tubular column 90 to permit the tubular column to rotate in relation to the two hollow sleeves 92. In addition, having the inside diameter of the two hollow sleeves 92 be marginally bigger than the outside diameter of the tubular column 90 allows the user to lift one of the blocks out and detach it from the block it was connected to. One or more pins 94 can be inserted into a tubular column 90 to prevent undesired vertical movement of the two hollow sleeves 92.

For example, from the configuration shown in FIG. 9, a user could lift out the first block 10 and separate it from the second block 20. In addition, the user could also lift out the second block 20 and separate it from the third block 30. Then, the user could stack the first block 10 on top of the second block 20 and store the first block 10 and the second block 20 underneath the third block 30 as shown in FIG. 10. In this alternate configuration, it is preferred that the first horizontal platform 14 and the second horizontal platform 24 be approximately 9 inches wide and 14 inches long. In this alternate configuration, it is preferred that the third horizontal platform 34 be approximately 11 inches wide and 16 inches long.

The heights of the blocks can vary or they can be all the same height depending on the desire of the user. It is preferred, however, that blocks increase in height from the first to the third. More specifically, it is preferred that the third height 32 be permit a user to have a 90° knee bend with single foot placement. It has been found that an exercise device having a first height is between 6 and 10 inches, a second height is between 10 and 18 inches and a third height is between 18 and 24 inches can accommodate a wide range of potential users. More specifically, when it is not practical to custom fit an exercise device to a particular user, it is preferred that the first height be approximately 7 inches, the second height be approximately 14 inches and the third height be approximately 21 inches.

As shown in the drawings, the first block 10, the second block 20, and the third block 30 each have a horizontal platform. The first horizontal platform 14, second horizontal platform 24, and third horizontal platform 34 allow the user to easily step onto the exercise device 5 when engaged in an exercise or activity. As an option, the first horizontal platform 14, second horizontal platform 24, and third horizontal platform 34 can have a comfort pad, a resistance grip or both. A comfort pad is preferred to be constructed from ⅛ inch rubber, such as is commonly found on exercise equipment. Similarly, a resistance grip can be constructed by adding ribs or other gripping elements to an ⅛" rubber pad, such as is commonly found on exercise equipment in use today. Preferably, the comfort pad and the resistance grip are the same dimensions of the horizontal platforms 14, 24, and 34 so that they easily fit onto the exercise device 5.

Figure 5:
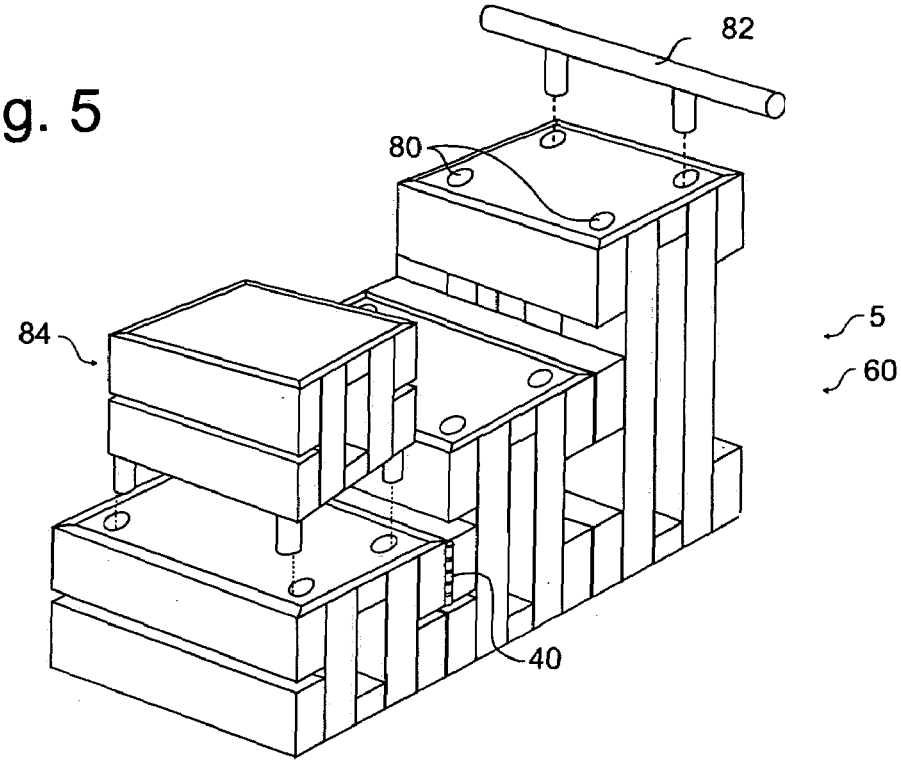
FIG. 5 illustrates a first preferred configuration of the exercise device 5 with insertion points, a removable bar, and a height level cap.
Figure 6:
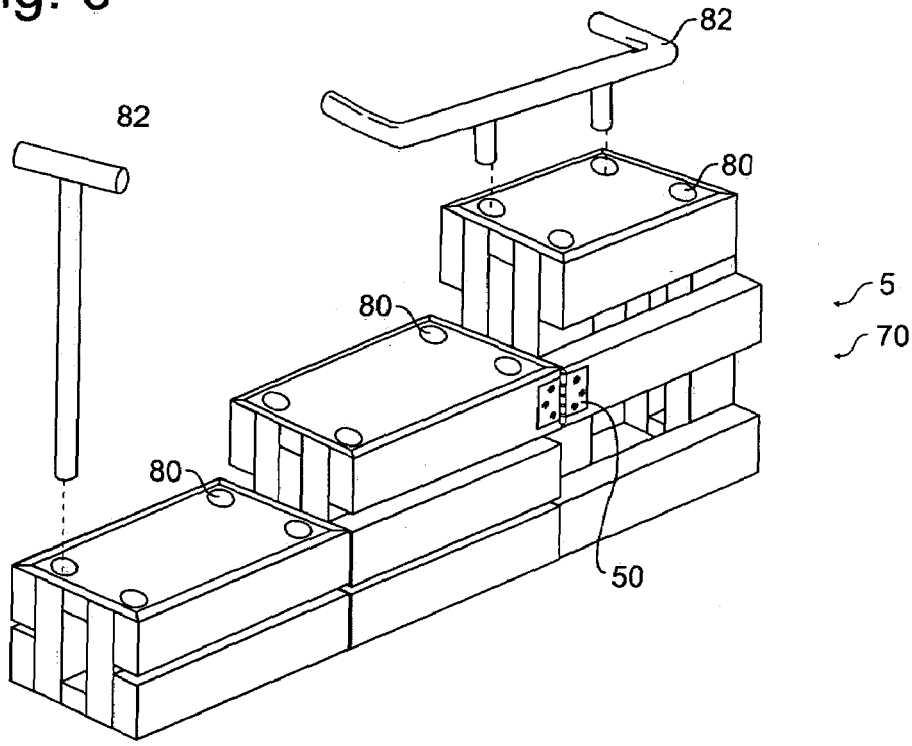
FIG. 6 illustrates a second preferred configuration of the exercise device 5 with insertion points and removable bars.

Further, in another alternate embodiment of the invention, the horizontal platforms 14, 24, 34 can have a plurality of insertion points 80. Examples of preferred placement of insertion points 80 are shown in FIGS. 5, 6, 9, and 10. The insertion points 80 allow the user to add equipment to the exercise device 5 by inserting the additional equipment into the insertion points 80. The insertion points 80 are a diameter and a distance apart from each other to allow the additional equipment to be easily inserted and removed from the exercise device 5 as shown in FIGS. 5 and 6.

The additional equipment can include removable bars 82 and height level caps 84. A removable bar 82 can be of any shape and/or size to facilitate a desired activity. In the preferred embodiment, there can be several removable bars 82. Preferably, the removable bar 82, such as the ones shown in FIG. 6., is configured to allow the user to do exercises such as push-ups, dips, and pull-ups, Additionally, a user of the exercise device 5 can use the removable bar 82 for balance or stabilization.

In addition, one or more height level caps 84 can be placed into the insertion points 80 to build a wider and level base on the exercise device 5. Preferably, a height level cap 84 for the first block 10 is of a dimension that effectively modifies the first height 12 to be equivalent to the second height 22 or the third height 32 as desired. Likewise, it is preferred that a height level cap 84 for the second block 20 is of a dimension that effectively modifies the second height 22 to be equivalent to the third height 32. As a result, adding height level caps 84 will result in the top of the modified first block 10, the second block 20, and the third block 30 will be flush to provide a flat-surfaced exercise device 5 for the user. Adding height level caps 84 when the exercise device is in the first position 60, creates a wide and flat exercise device 5 that can be used for plyometric type exercises, single/dual foot step-ups. Adding height level caps 84 when the exercise device is in the second position 70 makes a sturdy weight bench for weightlifting and other exercises.

Figure 7:
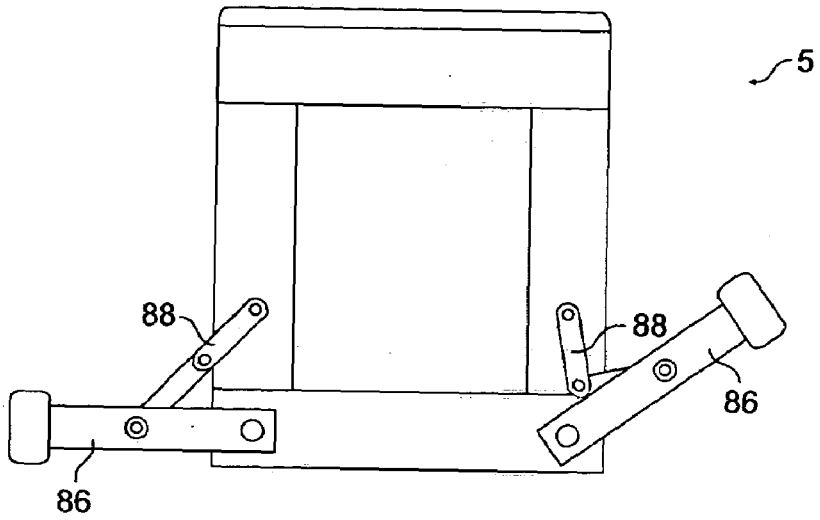
FIG. 7 illustrates the exercise device 5 having optional stabilizer bars.

Moreover, as shown in FIG. 7, it is preferred that the exercise device 5 be equipped with stabilization bars 86. The stabilization bars 86 are attached to the exercise devise 5 with locking hinges 88. Further, the stabilization bars 86 provide support to the exercise device 5 to keep it from falling over while in use.

The exercise device 5 is a strength and bodybuilding tool for the upper body as well, useful for bi-level push-ups, dips, and abdominal balance and bridge movements and holds at multiple-levels. Along with resistance from range of motion and varying heights and planes of movement, the exercise device works synergistically and is intended to work in unison with resistances such as dumbbells, weighted pipes, sticks, medicine balls or other implements. It can be used for individual home or fitness gym use. The exercise device also serves as a flexibility stretching apparatus. The range of motion possibilities allows arcs of upper or lower torso limb movement in all planes of motion with increased vertical depth and spheres. The exercise device can be used in unison with other types of exercise tools such as dumbbells, weighted pipes, sticks, and medicine balls. Although primarily invented for health and fitness training, the device can also be used as stepladder, bench, or other structural support.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A multi-configurable exercise device adapted for a user to step upon, the device comprising a first substantially rectangular block having a first height, a first horizontal platform and a first support member wherein the first substantially rectangular block is supported from below by the first support member;

a second substantially rectangular block having a second height, a second horizontal platform, a second support member, a first vertical corner and a second vertical corner wherein the second substantially rectangular block is supported from below by the second support member;

a third substantially rectangular block having a third height, a third horizontal platform and a third support member wherein the third substantially rectangular block is supported from below by the third support member;

a first hinge connected to a vertical corner of the first block and the first vertical corner of the second block wherein the first hinge rotates about a first axis that is perpendicular to the first horizontal platform; and a second hinge connected to a vertical corner of the third block and the second vertical corner of the second block wherein the second hinge rotates about a second axis that is perpendicular to the second horizontal platform.

2. The exercise device of claim 1 wherein the first vertical corner is located diagonally opposite from the second vertical corner.

3. The exercise device of claim 1 wherein the exercise device can be configured into first position and a second position, wherein the spatial orientation of the first block, second block and third block in the first configuration is different from the spatial orientation of the first block, second block and third block of the second configation.

4. The exercise device of claim 1, wherein the first height is between 6 and 10 inches, the second height is between 10 and 18 inches and the third height is between 18 and 24 inches.

5. The exercise device of claim 1, wherein the first height is approximately 7 inches, the second height is approximately 14 inches and the third height is approximately 21 inches.

6. The exercise device of claim 1, wherein the first block, the second block and the third block are made from materials selected from the group consisting of aluminum, plastic, composites and wood.

7. The exercise device of claim 1 wherein the height of the second block is lower than the height of the third block.

8. The exercise device of claim 1 wherein the height of the first block is lower than the height of the second block.

9. The exercise device of claim 1 further comprising at least one insertion point on the exercise device, wherein the insertion point is located on the exercise device at a location selected from a group consisting of the first horizontal platform, the second horizontal platform and the third horizontal platform.

10. The exercise device of claim 9 further comprising a removable bar that fits into the at least one insertion point.

11. The exercise device of claim 9 further comprising a height level cap that fits into the at least one insertion point.

12. The exercise device of claim 1 further comprising a comfort pad attached to the first horizontal platform, the second horizontal platform, or the third horizontal platform.

13. The exercise device of claim 1 further comprising a resistance grip attached on the exercise device, wherein the resistance grip is located on the exercise device at a location selected from a group consisting of the first horizontal platform, the second horizontal platform and the third horizontal platform.

14. The exercise device of claim 1 further comprising a pair of stabilization bars connected to the exercise device at a location selected from a group consisting of the first block, the second block and the block platform.

15. The exercise device of claim 14 further comprising a pair of locking hinges connected between the exercise device and a stabilization bar.

16. The exercise device of claim 1 wherein the first block, the second block, and the third block are made from materials selected from a group consisting of aluminum, plastic, and wood.

17. A multi-configurable exercise device adapted for a user to step upon, the device comprising a first substantially rectangular block having a first height, a first horizontal platform and a first support member wherein the first substantially rectangular block is supported from below by the first support member;

a second substantially rectangular block having a second height, a second horizontal platform, a second support member, a first vertical corner and a second vertical corner wherein the second substantially rectangular block is supported from below by the second support member;

a third substantially rectangular block having a third height, a third horizontal platform and a third support member wherein the third substantially rectangular block is supported from below by the third support member;

a first hinge connected to a vertical corner of the first block and the first vertical corner of the second block wherein the first hinge rotates about a first axis that is perpendicular to the first horizontal platform; and a second hinge connected to a vertical corner of the third block and the second vertical corner of the second block wherein the second hinge rotates about a second axis that is perpendicular to the second horizontal platform, wherein the exercise device can be configured into a first position and a second position such that the spatial orientation of the first, second and third blocks in the first position is different from the spatial orientation of the first, second and third blocks in the second position.

* * * * *